United States Patent [19]

Handler et al.

[11] Patent Number: 5,048,692

[45] Date of Patent: Sep. 17, 1991

[54] BAG CLOSURE STRUCTURE IN WHICH A SINGLE RESEALABLE CLOSURE ACTS AS BOTH THE PRIMARY AND SECONDARY CLOSURES

[75] Inventors: Michael D. Handler, Weston; Robert W. Schwier, Greenwich, both of Conn.

[73] Assignee: Colgate-Palmolive Company, Piscataway, N.J.

[21] Appl. No.: 537,608

[22] Filed: Jun. 14, 1990

Related U.S. Application Data

[63] Continuation-in-part of Ser. No. 504,595, Apr. 3, 1990, abandoned.

[51] Int. Cl.[5] ..... B65D 33/25

[52] U.S. Cl. ..... 206/618; 383/61; 383/63; 383/85; 383/89; 383/113; 383/114

[58] Field of Search ..... 383/61, 63, 66, 84, 383/85, 88, 89, 90, 95, 97, 109, 113, 114, 121, 123; 206/618, 610

[56] References Cited

U.S. PATENT DOCUMENTS

| | | | |
|---|---|---|---|
| 2,000,928 | 5/1935 | Cundall et al. | 383/89 X |
| 2,522,480 | 9/1950 | Davis | 383/66 |
| 3,807,626 | 4/1974 | Goodrich | 206/618 X |
| 3,910,488 | 10/1975 | Goodrich | 383/85 |
| 4,241,865 | 12/1980 | Ferrell | 383/61 |
| 4,337,889 | 7/1982 | Moertel | 383/61 |
| 4,637,063 | 1/1987 | Sullivan et al. | 383/113 X |
| 4,691,370 | 9/1987 | MacFee | 383/61 |
| 4,824,261 | 4/1989 | Provost | 206/610 X |
| 4,946,289 | 8/1990 | Bolling et al. | 383/61 |

FOREIGN PATENT DOCUMENTS

| | | | |
|---|---|---|---|
| 2313276 | 12/1976 | France | 383/97 |
| 2216867 | 10/1989 | United Kingdom | 383/123 |

*Primary Examiner*—Stephen Marcus
*Assistant Examiner*—Jes F. Pascua
*Attorney, Agent, or Firm*—Haynes N. Johnson

[57] ABSTRACT

A sealed multi-ply bag capable of being resealed including sides, a bottom, and front and back panels. A resealable closure is mounted across the top edges of the front and back panels as the secondary closure. The front and back panels are folded one or more times about the resealable closure to form a primary closure. A sealing flap runs across the folded area to maintain the bag in its sealed, folded configuration. The upper portion of the front panel may be step cut to provide a tighter primary closure.

16 Claims, 2 Drawing Sheets

BAG CLOSURE STRUCTURE IN WHICH A SINGLE RESEALABLE CLOSURE ACTS AS BOTH THE PRIMARY AND SECONDARY CLOSURES

This is a continuation-in-part of our application Ser. No. 7/504,595, filed Apr. 3, 1990, now abandoned.

FIELD OF THE INVENTION

This invention relates to the field of bags having waterproof primary closures for use in shipping and storage and resealable secondary closures for use by the consumer. Typically, such bags are used for dog food, detergents, and the like.

BACKGROUND OF THE INVENTION

When storing and shipping filled bags, such as dog food bags, it is necessary that the bag be sealed so that grease, powders, and the like do not leak out during storage and shipment. A primary closure of this type is normally destroyed by the user when the bag is first opened. If the bag is to be resealable, it is also necessary to have a reusable secondary closure at the bag mouth, such as a zipper or a plastic zip-lock. Thus, two closure structures are incorporated at the mouth of the bag.

Examples of such structures will be found in Ferrell U.S. Pat. No. 4,241,865 and Sullivan U.S. Pat. No. 4,620,320, both using an inner chain stitch and an outer zipper; Griesbach U.S. Pat. No. 4,782,951, using a zip-lock outside sealed plastic sheets; and Provost U.S. Pat. No. 4,824,261, using an inner hook and loop fastener system (Velcro) inside an adhesively secured flap. In each of these systems two closure structures are required, adding to the cost of the package. Beck U.S. Pat. No. 4,498,192 uses flush cut tubes, in contrast to the present step cut.

In our bag closure system only one closure structure is needed to effect both the primary tight closure and the secondary resealable closure.

BRIEF SUMMARY OF THE INVENTION

We have found that a zip-lock, zipper, or similar resealable closure, even though it does not by itself provide a watertight seal, can be used as both the primary and secondary closure if the bag material is folded about the closure once or twice and then secured in position. In this manner, the folded bag itself serves as the primary seal, not requiring a separate structure.

In our structure the open end of multi-ply bag is first closed with a some type of resealable closure, such as a plastic zip lock. The upper end of the bag may be step cut, at least on the side to which the closure is folded to permit a sharper fold and, so, to provide a tighter seal. Just below the closure are one or two fold lines parallel to the closure, one immediately below the closure, if the bag is to be folded once, and a second one, if the bag is to be folded twice, parallel to the first fold line and a distance below it slightly greater than the width of the first fold.

The bag includes a paper or plastic flap, extending upwardly from the back panel, which folds over the closure, after it has been folded on the fold lines, and is adhered by adhesive or otherwise to the face of the bag, holding the folded closure in position.

Accordingly, a primary closure has been formed by the folding of the resealable closure and the front and back panels.

In use the user simply breaks the sealed flap, unfolds the end of the bag, and opens the resealable closure structure. The closure then serves as the secondary closure.

DETAILED DESCRIPTION OF THE INVENTION

Figure 1:
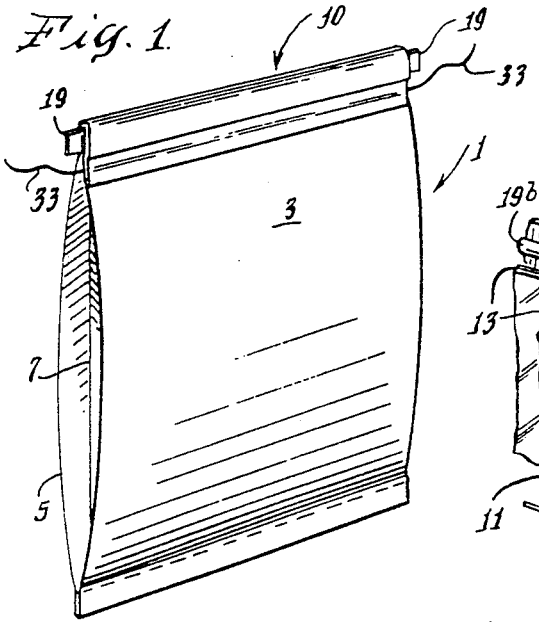
FIG. 1 is a perspective view of our bag, filled and sealed.
Figure 2:
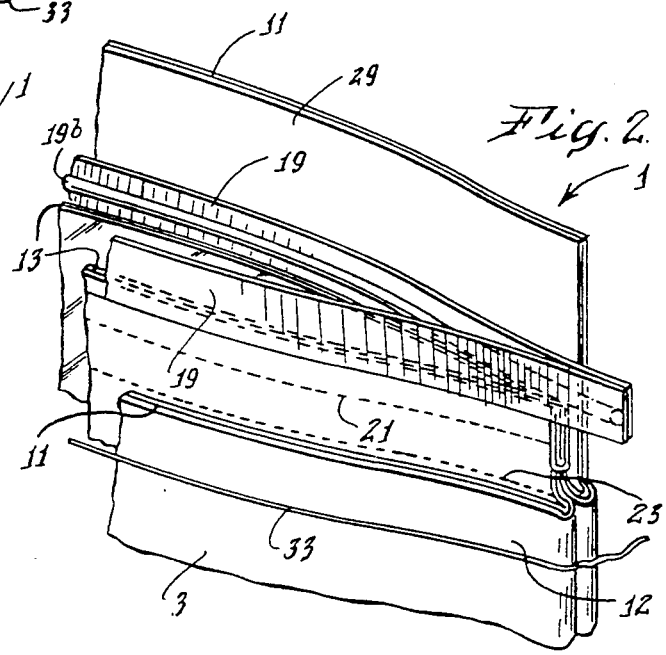
FIG. 2 is a perspective view of part of the upper portion of the bag with the resealable closure open and before the closure has been closed, the closure folded, and the flap sealed.

Our bag 1 is shown in perspective in FIG. 1 as it would be when sealed ready for shipment or storage. The bag can be used for dog food, detergents, or other products where a tight seal is necessary. Bag 1 is multiplied and includes a front panel 3, a back panel 5, gussets 7, and a closure area 10. It can be made of any desirable materials, but we prefer to form it of one or more outer plies of heavy paper 11, with a liner 13 formed of one or more plies of plastic or paper.

The top edges of the front and back panels form a linear top opening and are secured together by a resealable closure 19. The closure would normally have two interlocking portions 19*a* and 19*b*, each secured to one of the attachment flanges 30 and 31 for attachment to the front and rear panels of the bag. Flange 30, running the width of the bag, is attached across the top of front panel 3 in any desirable manner, such as by heat sealing, and flange 31 is attached across the top of rear panel in a similar manner. Normally, closure 19 would extend slightly beyond the two sides of the bag (See FIG. 1).

By "closure" we mean any type of resealable closure. We prefer a plastic zip-lock structure, but it could also be a zip-lock with a slider, the normal zipper with teeth and a slider to open and close it, or any similar structure.

Figure 3:
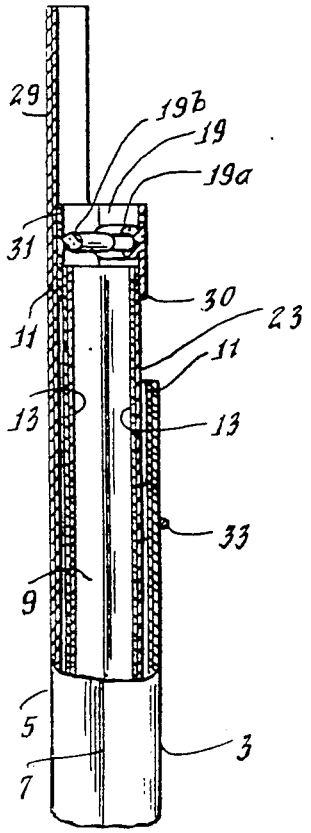
FIG. 3 is a transverse section showing the two inter-engaging portions of the resealable closure prior to closing.
Figure 4:
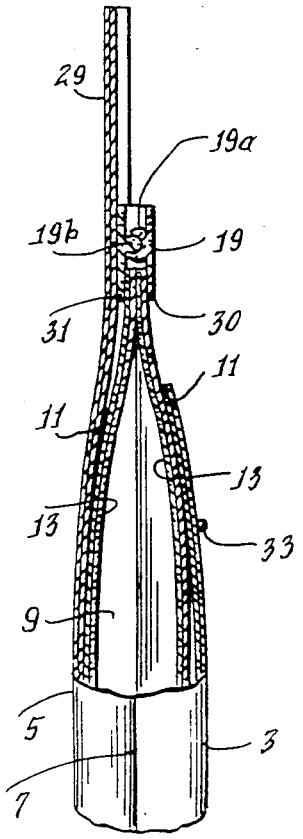
FIG. 4 is like FIG. 3 but with the resealable closure closed.
Figure 6:
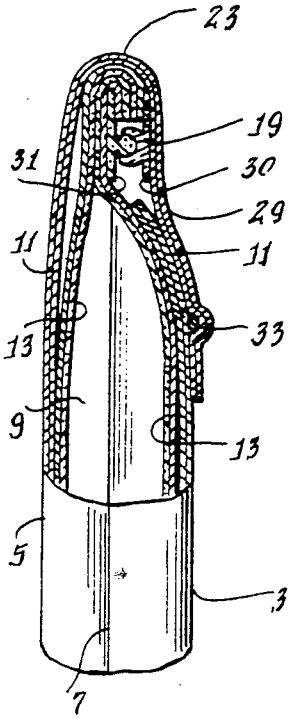
FIG. 6 is like FIG. 5, but with the sealing flap sealed to provide a good primary closure.
Figure 7:
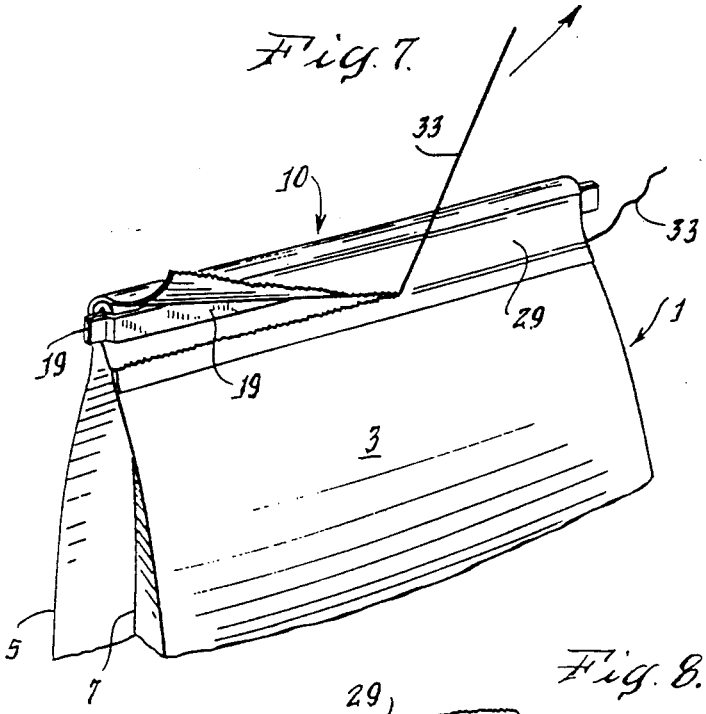
FIG. 7 is a partial perspective view showing the bag being opened, i.e., the primary closure being unsealed.

The paper and plastic are step cut relative to one another or to themselves. Here, as can be seen, at least one of the paper layers stops short of the other and of the plastic on the front panel of the bag (line 23, FIG. 3). This step cut in the front panel is from the top edge down a distance at least equal to the distance that the folded configuration, whether one or two folds, extends down the front panel. This permits a tighter fold and, so, a better primary closure (See FIGS. 6 and 9). If all the paper plies are removed in the step cut, the resulting fold will then be plastic to plastic and, so, an even tighter seal.

At least one ply of the paper portion of the rear panel 5 is extended to provide a sealing flap 29. The flap preferably extends the entire width of the closure.

Figure 5:
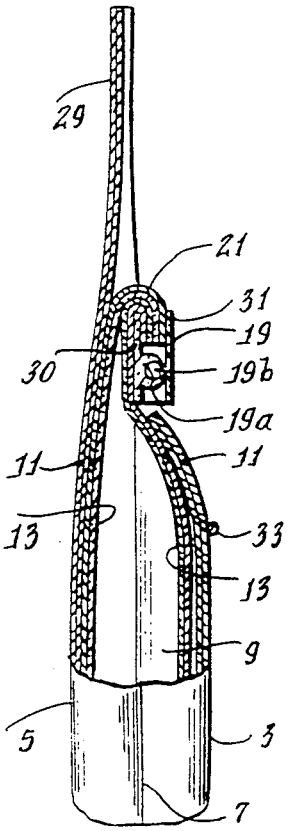
FIG. 5 is like FIG. 4 showing the closure with a single fold and before the sealing flap is sealed.
Figure 9:
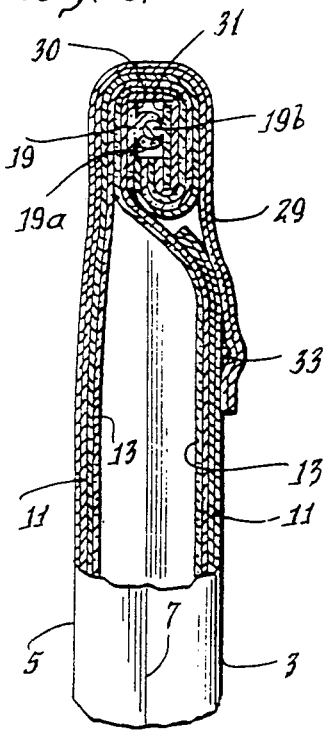
FIG. 9 is like FIG. 6 except using a double fold.

To form a primary closure for the bag, the closure 19 is closed and then it and at least one of the plies of the front and rear panels are folded forward and down once (as in FIG. 5) or, preferably, twice (as in FIG. 9). Sealing flap 29 is then folded over the top and sealed adhesively, or otherwise secured, to flap adhering area 12 near the top of front panel 3. This holds the fold or folds in place. Thus, a primary closure is achieved through this folding about resealable secondary closure 19; and the fold or folds, themselves create the seal, i.e., primary closure. If desired, a string 33 may be incorporated underneath the sealing flap for use in tearing the flap seal to open the bag.

A fold line 21 is below closure 19, parallel and proximate to the closure. If the closure is to be folded twice, there is a lower fold line 23 parallel to line 21 and spaced below it a distance slightly greater than the width of the fold. These fold lines may be impressed on the front panel before folding or may be created by actual folding of the closure area 10.

Figure 8:
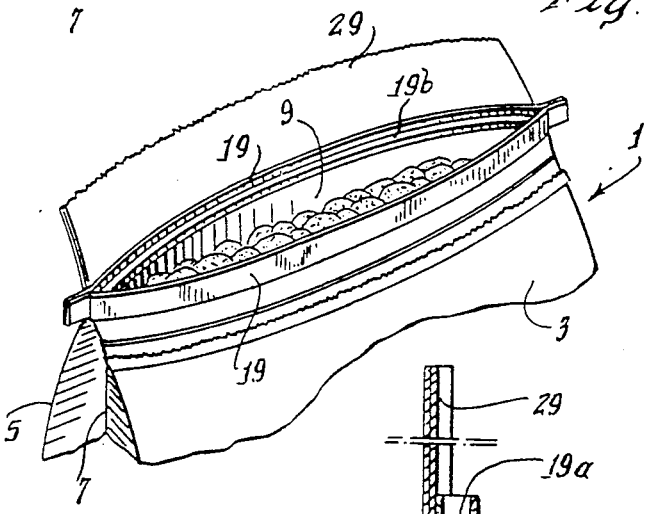
FIG. 8 is like FIG. 7 except the bag has now been completely opened.

When the user wishes to open the package, he breaks the seal created by the flap, by tearing it with string 33 or otherwise, unfolds the resealable closure 19, and opens it. He than has access to the contents, as shown in FIG. 8. After use, the bag can the be resealed with closure 19.

As can be seen, we have produced a bag having both a primary and a secondary seal by use of a single closure, i.e., the closure 19 together with folding. Thus, two separate closure structures are not required, reducing the cost of manufacture.

Figure 10:
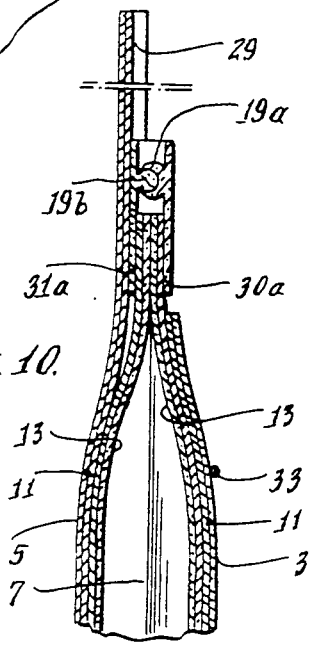
FIG. 10 is like FIG. 4 except that the attachment flanges extend farther down the bag, often useful when double fold sealing is desired.

FIGS. 9 and 10 show modifications of our invention. In FIG. 9 the closure 19 has been twice folded, for an even better seal. In FIG. 10 attachment flaps 29 and 30 are extended a sufficient length to accompany the double folding.

We claim:

1. A multi-ply bag capable of being sealed and, after initial opening, being resealed, said bag including sides, a bottom, and a linear top opening having a front panel and a back panel, a resealable closure having attachment flanges mounted horizontally across said linear top opening by securing said flanges to said panels, said resealable closure having width running vertically and a length running horizontally thereof, an upper fold line across said front panel parallel to, proximate to, and below said resealable closure, a second fold line parallel to said upper fold line and spaced from it a distance approximately equal to said width of said resealable closure, said front and back panels being twice folded forwardly about said resealable closure in folded configuration to form a seal, and means for maintaining said upper front and back panels in said folded configuration, whereby a bag is formed having both primary and secondary closures.

2. A multi-ply bag as set forth in claim 1 in which the upper portion of said front panel is step cut in the area of said folded configuration to provide for a tighter seal.

3. A multi-ply bag as set forth in claim 1 in which said means for maintaining said folded configuration is a sealing flap formed by an upward extension of said back panel and running substantially said length of said reasonable closure, said sealing flap passing over said folded configuration and being secured to said front panel.

4. A multi-ply bag in which a single closure serves as both a primary closure and a secondary closure, said bag including sides, bottom, and front and rear panels, said front and rear panels having a linear top opening, a resealable closure mounted across said linear top opening as a secondary closure, at least one foldline below said resealable closure and parallel thereto, said resealable closure and said front and rear panels being folded about said foldline at least once in a folded configuration to form a waterproof primary closure, and means for securing said primary closure in its said folded configuration to form a sealed configuration, whereby said bag is sealed and secured in its said sealed configuration.

5. A multi-ply bag as set forth in claim 4 in which said resealable closure and said front and back panels are folded twice.

6. A multi-ply bag as set forth in claim 4 in which the upper portion of said front panel is step cut to permit a tighter fold.

7. A multi-ply bag as set forth in claim 6 in which said step cut is approximately a distance which said folded configuration extends down said bag.

8. A multi-ply bag as set forth in claim 4 in which said securing means is a sealing flap extending upwardly from said back panel, passing over said primary closure, and being secured to said front panel.

9. A multi-ply bag as set forth in claim 8 in which said sealing flap extends the entire width of said bag.

10. A bag as set forth in claim 8 including a string positioned beneath said sealing flap, for tearing said sealing flap.

11. A multi-ply bag in which a single closure serves as both a primary closure and a secondary closure, said bag including sides, bottom, and front and rear panels, all being formed of at least one plastic inner ply and at least one paper outer ply, said front panels being step cut, and said front and rear panels having a linear top opening, a resealable closure mounted across said linear top opening of said front and rear panels as a secondary closure, said resealable closure and said front and rear panels being folded forwardly at least once to form a waterproof primary closure in a folded configuration, said step cut permitting tighter folding, and means for securing said primary closure in its folded configuration to form a sealed configuration, whereby said bag is sealed and secured in its said sealed configuration.

12. A multi-ply bag as set forth in claim 11 in which said step cut is through all of said paper outer plies.

13. A multi-ply bag as set forth in claim 11 in which said step cut is for a distance approximating the distance which said folded configuration extends down said bag.

14. A multi-ply bag capable of being sealed and, after initial opening, being resealed, said bag including sides, a bottom, and a linear top opening having a front panel and a back panel, a resealable closure having attachment flanges mounted horizontally across said linear top opening by securing said flanges to said panels, said resealable closure having a width, an upper fold line across said front panel parallel to and proximate to said resealable closure, a second fold line parallel to said upper fold line and spaced from it a distance approximately equal to said width of said resealable closure, said front and back panels being twice folded forwardly about said resealable closure in folded configuration to form a seal, means for maintaining said upper front and back panels in said folded configuration, and said resealable closure being a zip-lock having two interengaging portions whereby a bag is formed having both primary and secondary closures.

15. A multi-ply bag capable of being sealed and, after initial opening, being resealed, said bag including sides, a bottom, and a linear top opening having a front panel and a back panel, a resealable closure having attachment flanges mounted horizontally across said linear top opening by securing said flanges to said panels, said resealable closure having a width, an upper fold line across said front panel parallel to and proximate to said resealable closure, a second fold line parallel to said upper fold line and spaced from it a distance approximately equal to said width of said resealable closure, said front and back panels being twice folded forwardly about said resealable closure structure in folded configuration to form a seal, means for maintaining said upper front and back panels in said folded configuration, and said attachment flange for said front panel extending downwardly approximately a distance said folded configuration extends down said front panel, whereby a bag is formed having both primary and secondary closures.

16. A multi-ply bag in which a single closure serves as both a primary closure and a secondary closure, said bag including sides, bottom, and front and rear panels, said front and rear panels having a linear top opening, said front and back panels including a liner of at least one ply of plastic and an outer layer of at least one ply of paper and in which said front panel is step cut below and parallel to said resealable closure, said cut being at least through all the plies of paper, a resealable closure mounted across said linear top opening as a secondary closure, at least one foldline below said resealable closure and parallel thereto, said resealable closure and said front and rear panels being folded about said foldline at least once in a folded configuration to form a primary closure, and means for securing said primary closure in its said folded configuration to form a sealed configuration, wherein said bag is sealed and secured in its said sealed configuration.

* * * * *